US006298499B1

(12) United States Patent
Huang

(10) Patent No.: US 6,298,499 B1
(45) **Date of Patent: *Oct. 9, 2001**

(54) REMOVABLE, PRESSURE-ADJUSTABLE, SHOCK ABSORBING CUSHION DEVICE WITH AN INFLATION PUMP FOR SPORT GOODS

(76) Inventor: Ing-Chung Huang, No. 15 REh-Her 1st Street, Kaohsiung (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/980,226

(22) Filed: Nov. 28, 1997

Related U.S. Application Data

(63) Continuation of application No. 08/112,185, filed on Aug. 26, 1993, now abandoned, which is a continuation of application No. 08/013,208, filed on Feb. 1, 1993, now abandoned, which is a continuation of application No. 07/741,091, filed on Aug. 5, 1991, now abandoned, which is a continuation of application No. 07/438,195, filed on Nov. 20, 1989, now abandoned, which is a division of application No. 07/180,288, filed on Apr. 11, 1988, now Pat. No. 4,912,861.

(51) Int. Cl.[7] ..... A41D 13/015
(52) U.S. Cl. ..... 2/455; 5/655.3; 36/93
(58) Field of Search ..... 2/455, 456, 413; 5/655.3; 36/54, 43, 71, 29, 30 R, 35 R, 44, 59 R, 114, 88, 89, 93

(56) References Cited

U.S. PATENT DOCUMENTS

| | | |
|---|---|---|
| 806,267 | 12/1905 | King . |
| 2,308,457 | 1/1943 | Saffir . |
| 2,638,690 | 5/1953 | Bullard . |
| 3,372,495 | 3/1968 | Finn . |
| 3,664,043 | 5/1972 | Polumbus, Jr. . |
| 3,685,176 | 8/1972 | Rudy . |
| 4,183,156 | 1/1980 | Rudy . |
| 4,583,305 | 4/1986 | Miyamoto . |
| 4,631,843 | 12/1986 | Annovi . |

FOREIGN PATENT DOCUMENTS

| | | |
|---|---|---|
| 2308547 | 8/1974 | (DE) . |
| 215974 | 1/1987 | (EP) . |

*Primary Examiner*—Michael A. Neas
(74) *Attorney, Agent, or Firm*—Jacobson, Price, Holman & Stern, PLLC

(57) ABSTRACT

A shock absorbing cushion device removable, pressure-adjustable for sports goods, comprising a cover and an air cushion enveloped in the cover, said cushion made as a hollow flat bag whose upper and lower sheets are provided and adhered with round recesses or line recesses or the both combined, said recesses furnishing the air cushion with shock absorbing elasticity and flexibility whether said cushion is inflated or not. An inflation pump or an air nipple is provided in said cushion for inflating or deflating said cushion.

1 Claim, 13 Drawing Sheets

REMOVABLE, PRESSURE-ADJUSTABLE, SHOCK ABSORBING CUSHION DEVICE WITH AN INFLATION PUMP FOR SPORT GOODS

This is a continuation of application Ser. No. 08/112,185 filed Aug. 26, 1993, now abandoned, which in turn is a continuation of application Ser. No. 08/013,208, filed Feb. 1, 1993, now abandoned, which is a continuation of application Ser. No. 07/741,091, filed Aug. 5, 1991, now abandoned, which is a continuation of application Ser. No. 07/438,195, filed Nov. 20, 1989, now abandoned, which is a divisional of application Ser. No. 07/180,288, filed Apr. 11, 1988 (now U.S. Pat. No. 4,912,861).

BACKGROUND OF THE INVENTION

1. Field of the Invention

This invention generally relates to shock-absorbers for sports equipment and, more particularly, to absorbers inflatable by a pump to an adjustable pressure.

2. Description of Related Art

Sports shoes are generally provided with tongues which are provided with a thin layer of sponge. The shock-absorbing function of the thin sponge layer is not ideal during use, because the user not only feels pressure against his foot, but also discomfort owing to the lace binding, the foot being full of blood vessels and sinews. When a foot stops during exercise, the shock forces against the shoe mainly fall on the tongue and the lace section in addition to the toe box. The thin sponge layer of the tongue cannot endure such shock forces against the foot.

It would be desirable to make a shoe tongue that could endure such shock forces, could be provided with different shock-absorbing capabilities to cope with both walking and exercising, and could be comfortable without pressing the foot.

There is a kind of hard skiing shoe provided with air-inflated shoe tongues, each made of two pieces stuck together and forming an empty pocket if the air should leak out owing to breakage or wear and tear. Once the tongues become flat, they can hardly be repaired. The entire skiing shoes have to be discarded. This is wasteful and uneconomical.

SUMMARY OF THE INVENTION

The inventor, after practical study and experiments, has worked out a shock-absorbing cushion device for shoe tongues which can be removed, changed to a new one, and is adjustable in its internal pressure by use of an inflation pump. The device is able to be used in sports shoes, boots, knee protectors, and other sports goods.

OBJECTS OF THE INVENTION

The objects of this invention are set forth below:

1. To furnish a kind of shock-absorbing cushion device whose inflation pressure is adjustable as desired, thereby selecting the degree of elastic absorption.

2. To furnish a kind of shock-absorbing cushion device that can maintain the original shock-absorbing space and function, without becoming flat even if the device was damaged or was not inflated.

3. To furnish a kind of shock-absorbing cushion device that can be adjusted in its internal pressure such that the sports goods may have tight contact with a part of the body to be protected and the capability of absorbing shock.

4. To furnish a kind of shock-absorbing cushion device that can be inflated or deflated according to different necessity while in use.

5. To furnish a kind of shock-absorbing cushion device that is waterproof and does not separate.

6. To furnish a kind of shock-absorbing cushion device that can absorb unbalanced shock forces, change them into a balanced shock force, and remove foot pressure and discomfort.

7. To furnish a kind of shock-absorbing cushion device that can easily be fixed on or taken off a sports goods.

8. To furnish a kind of shock-absorbing cushion device that can be used in a shoe tongue to prevent the shoe lace from becoming loose, tight, unbalanced or unstable.

9. To furnish a kind of shock-absorbing cushion device that can be used in a shoe tongue to make feet comfortable by inflating said tongue to a proper pressure when a user puts on the shoes, and can enable the shoes to be taken off easily by deflating the air inside.

FEATURES OF THE INVENTION

This shock-absorbing cushion device is removable and pressure-adjustable and is used in sports goods. The device comprises a cover and an air cushion enveloped in the cover. By means of blow shaping, the air cushion is shaped as a hollow bag made up of two sheets of polyethylene or an analogous material. The two sheets, an upper and a lower, are provided with vertical round recesses or vertical linear recesses extending crosswise or lengthwise of the cushion. The sheets are adhered together at the recesses. The recesses enable the air cushion to have shock-absorbing elasticity and flexibility. The recesses maintain the flatness of the outer surface of the cushion whether the air cushion is inflated or not, in order to cope with the bending movement of a part of a human body. The air cushion can be provided with an inflation pump or an air nipple for inflating or deflating the cushion.

The air cushion combined together with the cover can be fixed on sports goods such as sports shoes, knee protectors, shoulder protectors, etc., by means of shoe laces, snap fasteners, sticker fasteners, etc.

DETAILED DESCRIPTION OF THE PREFERRED EMBODIMENTS

Figure 1:
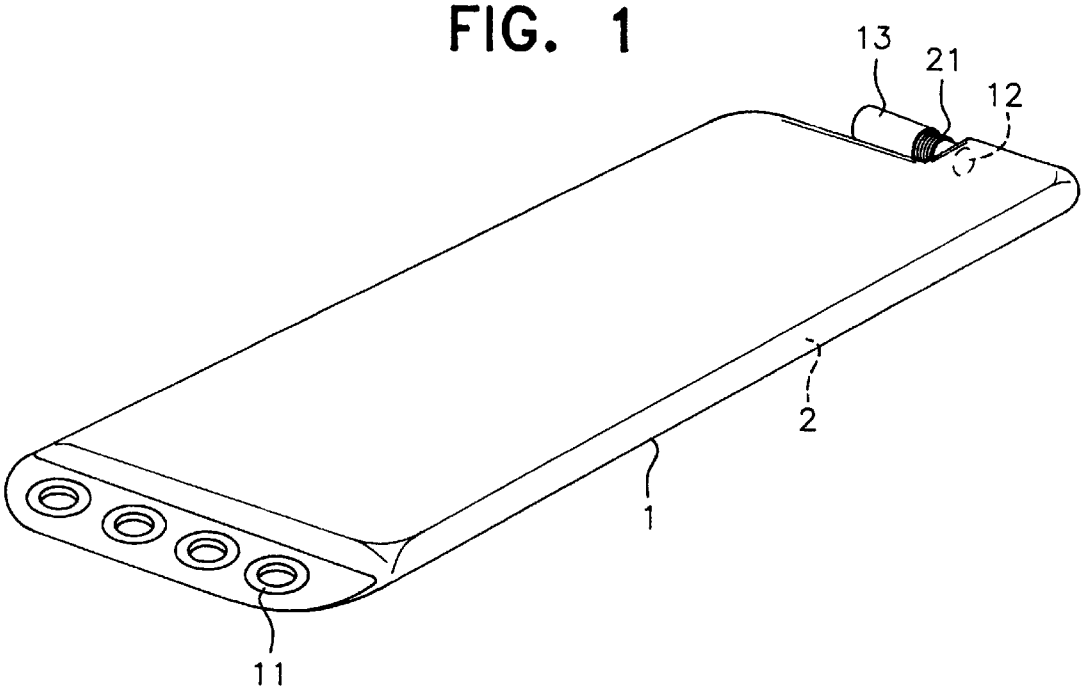
FIG. 1 is a perspective view of the removable pressure-adjustable shoe tongue with an inflation pump in accordance with the present invention.

The removable, pressure-adjustable, shock-absorbing cushion device in accordance with the present invention, as applied to a shoe tongue, is shown in FIG. 1. The shoe tongue comprises a cover 1 and an air cushion 2. The cover 1 is made of cloth, leather or any other fiber, and contains and keeps the air cushion 2 inside the cover. The cover is provided with several eyelets 11 at its front for a shoe lace to penetrate and a hole 12 at its rear edge. An inflation pump 21 or an air nipple 23 extends through the hole 12. A bag 13 envelopes the inflation pump 21 when the pump is not in use. The cover 1 can be combined with the shoe by means of the eyelets 11 or analogous fasteners such as a zipper, snap fasteners, sticker fasteners, or buttons, etc.

The air cushion 2 can be made of polyethylene, ethylene, or any other material with excellent elasticity, flexibility, extensibility and durability against low temperature, and that is easy to shape by blowing techniques. The air cushion 2 is provided with a plurality of round recesses or linear recesses on its upper and lower sheets. The bottoms of the recesses 201 (see FIG. 6) on both sheets are adhered together so that the vertical cross-section of each recess has a square shape. The arrangement of round and linear recesses can be changed in many ways but they have to be located so as to balance in the lengthwise and crosswise directions. The vertical sustaining force and the elasticity that both vertical side walls of round recesses or linear recesses produce make up effectively the sustaining force of the whole hollow air cushion. This shock-absorbing cushion device design provides an excellent outer surface flatness and a strong interactive sustaining function and prevents possible deformation due to high pressure. Of importance is that the air cushion 2 itself can never be totally flattened because of the vertical square cross-section of the round or linear recesses even if the cushion is damaged or not yet inflated.

Figure 2:
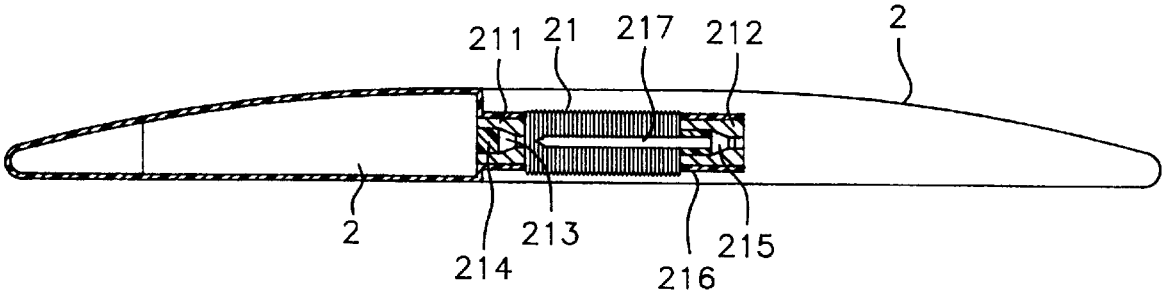
FIG. 2 is a cross-sectional view of the inflation pump in the shoe tongue in accordance with the present invention.
Figure 3:
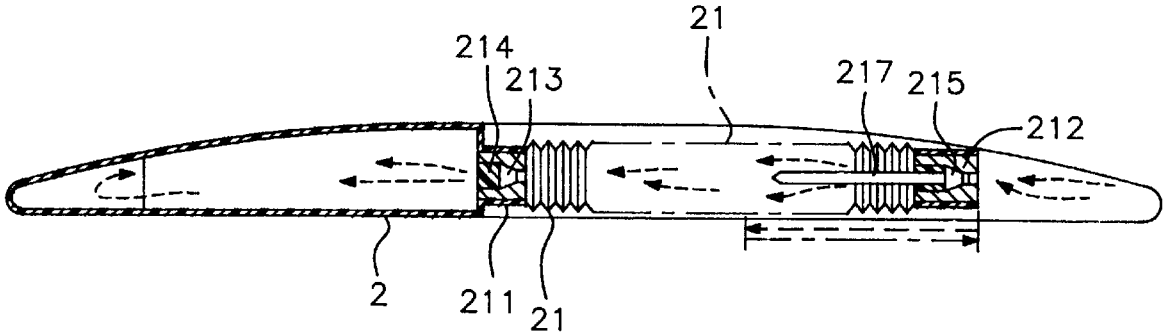
FIG. 3 is an operational view of the inflation pump and the air cushion inside the shoe tongue in accordance with the present invention.
Figure 4:
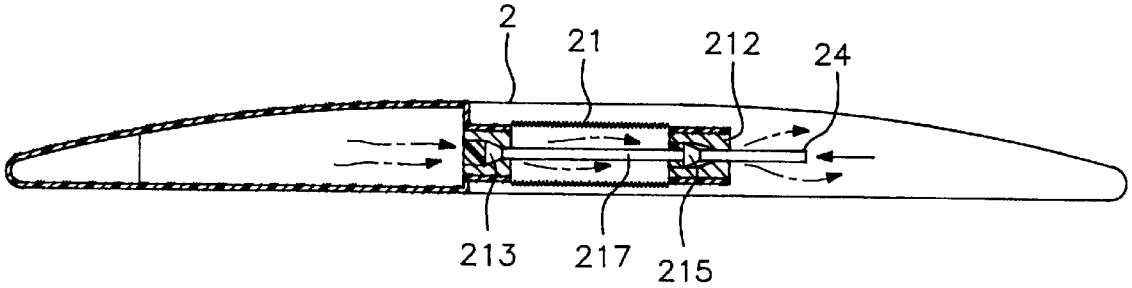
FIG. 4 is an operational view of the inflation pump under deflating action in accordance with the present invention.
Figure 5:
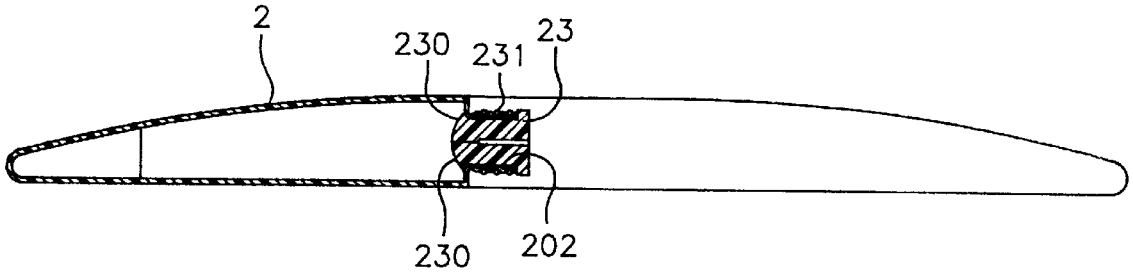
FIG. 5 is a cross-sectional view of the air nipple set on the shoe tongue in accordance with the present invention.

As shown in FIGS. 2, 3 and 4, the rear end of the inflation pump 21 is fixed steadfast with the air cushion as one unit. The pump 21 is an elastic tube that can be expanded or contracted to draw in air through a one-way valve 215 set in a valve base 212 at the front. Another one-way valve 213 set in a valve base 211 at the rear cooperates with the valve 215 to draw in the air. Sponges 214, 216 surround the valves 213, 215, giving them auxiliary force for stabilizing the position of said valves 213, 215 when they return to their original positions. The sponges also filter the air drawn in. In addition, a bar 217 extends backward from the valve 215, penetrates through the sponge 216 and reaches to the middle of the elastic tube of the pump 21. The bar 217 does not touch the rear of the valve 213 in the original position, but can be pushed back by the valve 215 to push the valve 213 if a little bar 24 is inserted into the front of the inflation pump 21 pushing back the valve 215, whereupon both valves 213, 215 are opened to release the air inside the air cushion 2.

Figure 17:
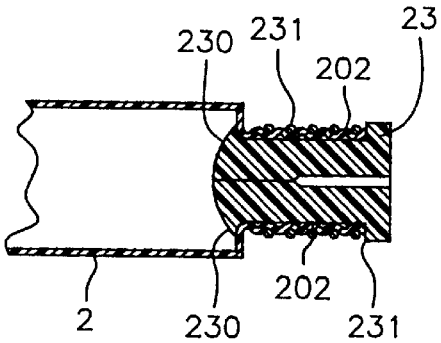
FIG. 17 is an enlarged cross-sectional view of an air cushion combined with an air nipple in accordance with the present invention.

The inflation pump 21 can be replaced by an air nipple 23 made of rubber. A needle is inserted into the nipple to inflate or deflate the air cushion 2. The air nipple 23 has several outward protrusions 230 at its end which is set in a round tube 202. The protrusions prevent the nipple from falling off said tube 202. The tube 202 is tightly bound around by several rubber bands 231 to prevent the air nipple from falling off at the same time. The main function of the rubber bands is to prevent the air cushion 2 from exploding open if the cushion 2 should receive a shock force larger than it can endure. Such a shock force greater than the binding force of the rubber bands would produce a gap between the air nipple 23 and the tube 202, thereby causing the air inside the cushion 2 to escape through the gap. As FIG. 17 shows, the outer circumference of the tube 202 can be shaped as a thread and the cross-section of the thread may be triangular, square, semicircular, oblong or any shape, provided that the air nipple 23, after set in the tube 202, can strongly resist the escape of air.

Next, examples of air cushions provided with round recesses 20 (see FIG. 12) and linear recesses 201, either separately or in combination, are described with reference to the Figures.

Figure 6:
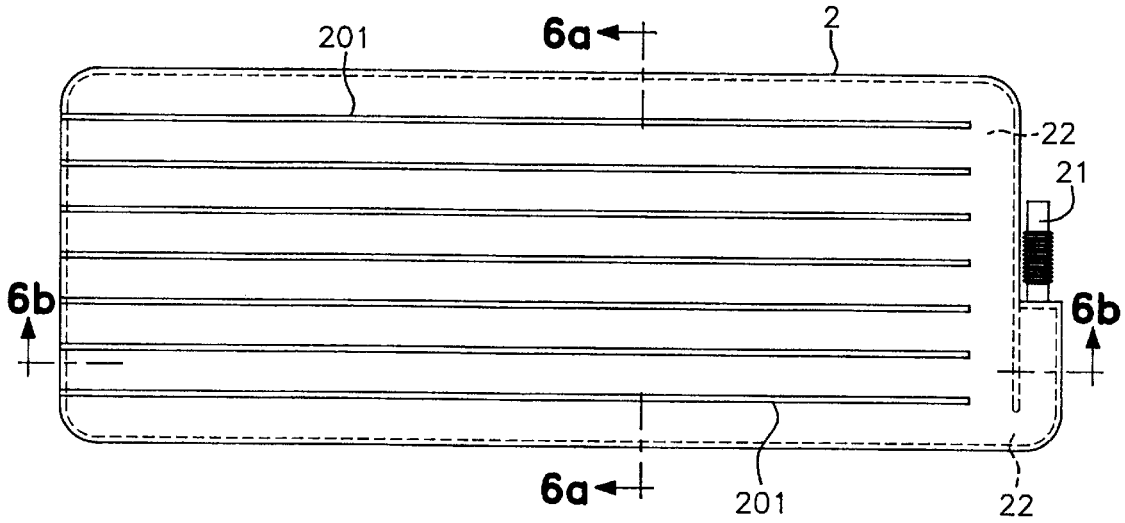
FIG. 6 is a top plan view of an embodiment of an air cushion inside the shoe tongue in accordance with the present invention.
Figure 6A:
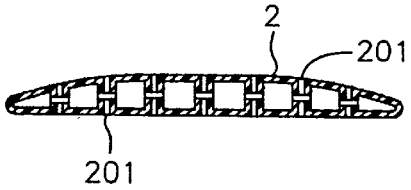
FIG. 6*a* is a cross-sectional view taken on line 6*a*—6*a* of FIG. 6.
Figure 6B:
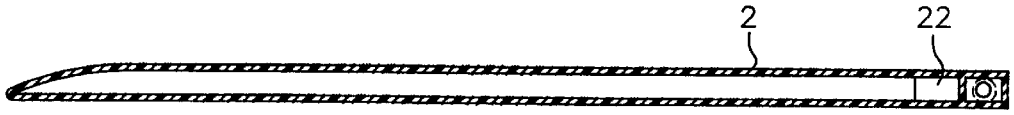
FIG. 6*b* is a cross-sectional view taken on line 6*b*—6*b* of FIG. 6.

FIGS. 6, 6-1, 6-2 show a kind of air cushion 2 provided with lengthwise linear recesses 201, but one end of every linear recess 201 is not connected with a circumferential edge of the cushion so that air can circulate through a passage formed between the circumferential edge and the ends of the linear recesses 201. The upper and lower sheets of the cushion 2 have a flat surface and the cross-section of the air space inside the cushion 2 is shaped as a square. The cushion is inclined at its peripheral edges according to the inclined upper surface of the foot.

Figure 7:
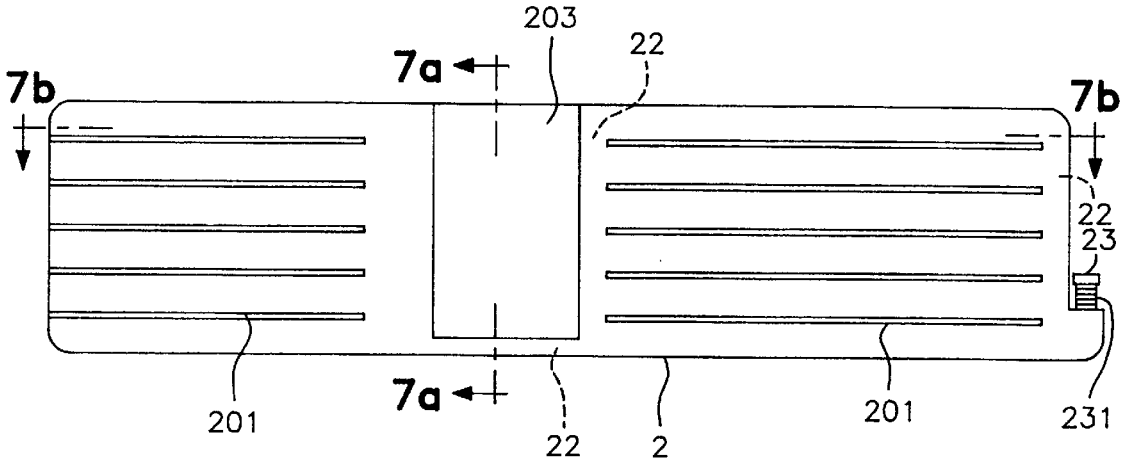
FIG. 7 is a top plan view of another embodiment of an air cushion inside the shoe tongue used for boots in accordance with the present invention.
Figure 7A:
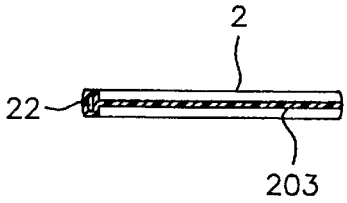
FIG. 7*a* is a cross-sectional view taken on line 7*a*—7*a* of FIG. 7.
Figure 7B:
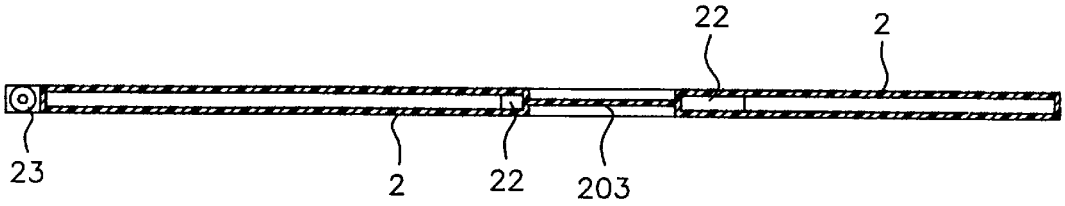
FIG. 7*b* is a cross-sectional view taken on line 7*b*—7*b* of FIG. 7.

FIGS. 7, 7-1, 7-2 show an example of an air cushion used for a boot with a little change added to the example shown in FIG. 6. This cushion is provided with a square flat section 203. Between the inside ends of the linear recesses 201 on both sides of said section 203 is separately set a passage for the air inside to pass through. The outside ends of said recesses 201 are either connected or not connected with a respective circumferential edge. The embodiment of FIG. 7 is provided with an air nipple 23.

Figure 8:
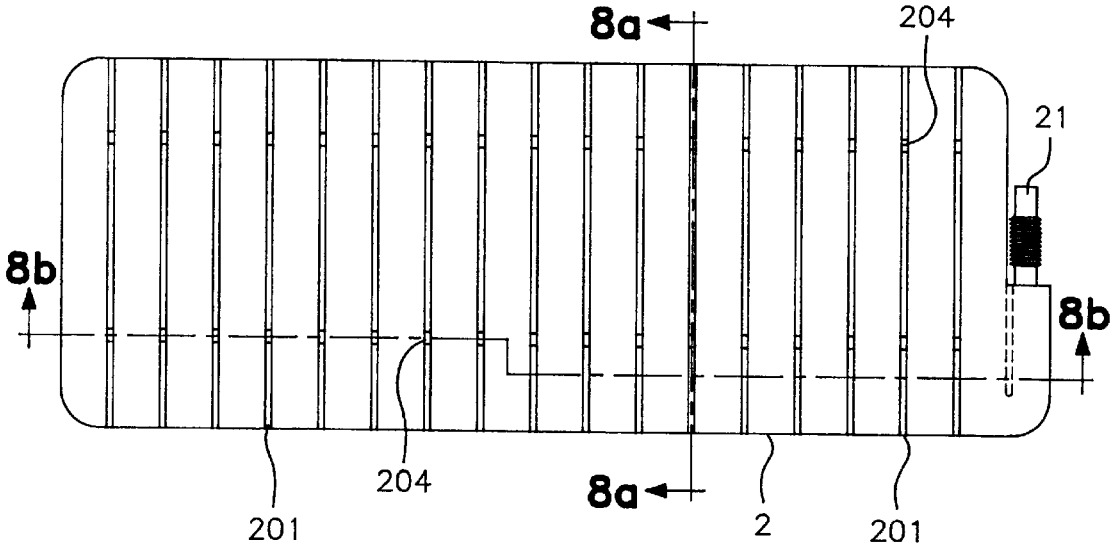
FIG. 8 is a top plan view of still another embodiment of an air cushion in the shoe tongue in accordance with the present invention.
Figure 8A:
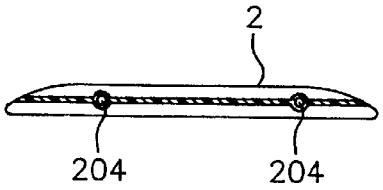
FIG. 8*a* is a cross-sectional view taken on line 8*a*—8*a* of FIG. 8.
Figure 8B:
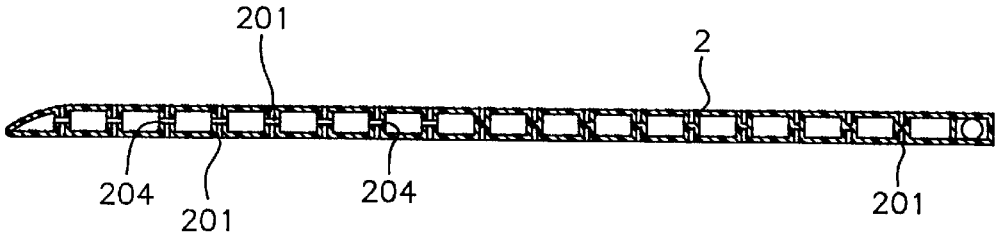
FIG. 8*b* is a cross-sectional view taken on line 8*b*—8*b* of FIG. 8.

FIGS. 8, 8-1, 8-2 show an example of an air cushion 2 with crosswise linear recesses 201 connected with a circumferential edge of the cushion at both ends, thereby dividing the inside space into a plurality of crosswise independent rooms. Short tubes 204 of smaller diameter than the height of the air cushion are set across the recesses 201 for the air in each independent room to pass through. Therefore, this cushion can acquire good crosswise flexibility owing to the crosswise recesses 201. The comparatively small tubes 204 never hamper the cushion from bending. The tubes 201 are not easily broken. The vertical cross-section of the linear recesses resembles a square.

Figure 9:
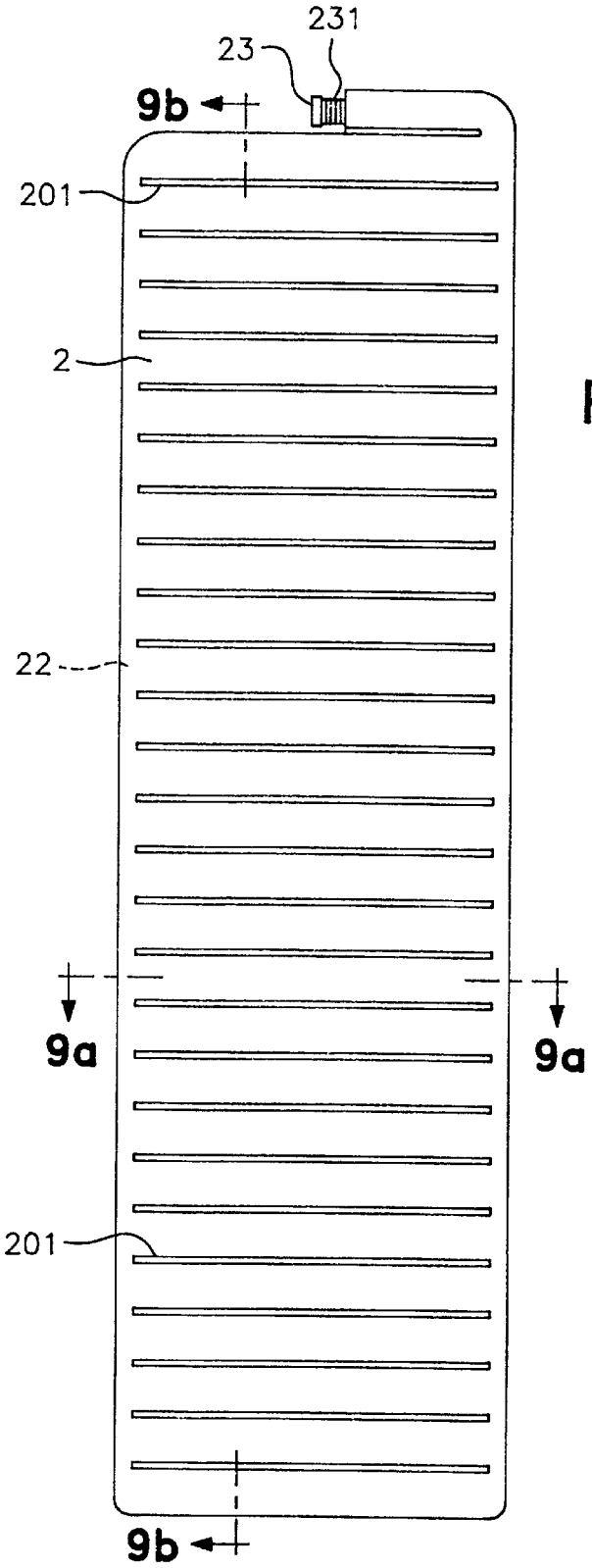
FIG. 9 is a top plan view of an additional embodiment of an air cushion in the shoe tongue used in boots in accordance with the present invention.
Figure 9A:
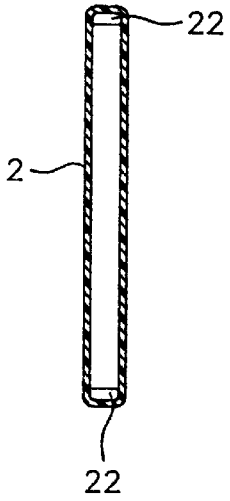
FIG. 9*a* is a cross-sectional view taken on line 9*a*—9*a* of FIG. 9.
Figure 9B:
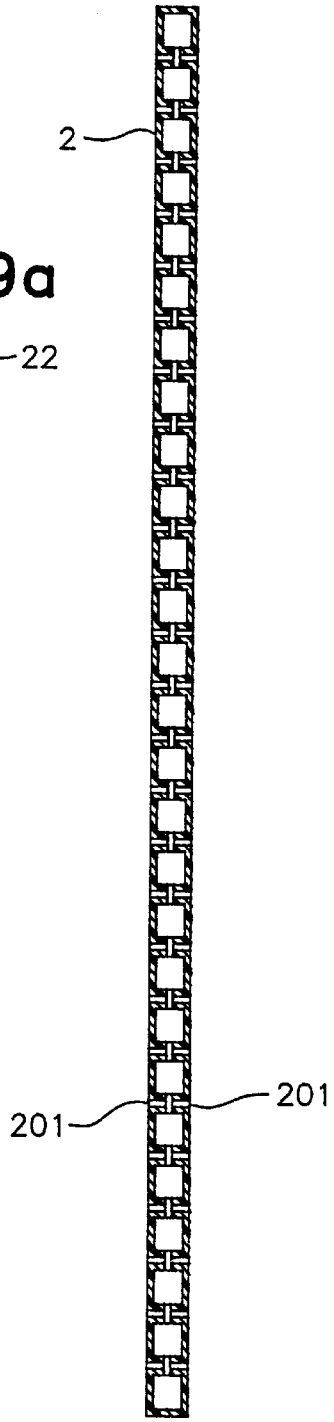
FIG. 9*b* is a cross-sectional view taken on line 9*b*—9*b* of FIG. 9.

FIGS. 9, 9-1, 9-2 show an example of an air cushion used for a boot with the crosswise linear recesses 201 of FIG. 8 changed a little. Both ends of the linear recesses 201 do not connect with the circumferential edges such that passages are formed between the ends of said recesses 201 and said edges. This cushion 2 can be bent crosswise and can be provided with an air nipple 23 or an inflation pump 21.

Figure 10:
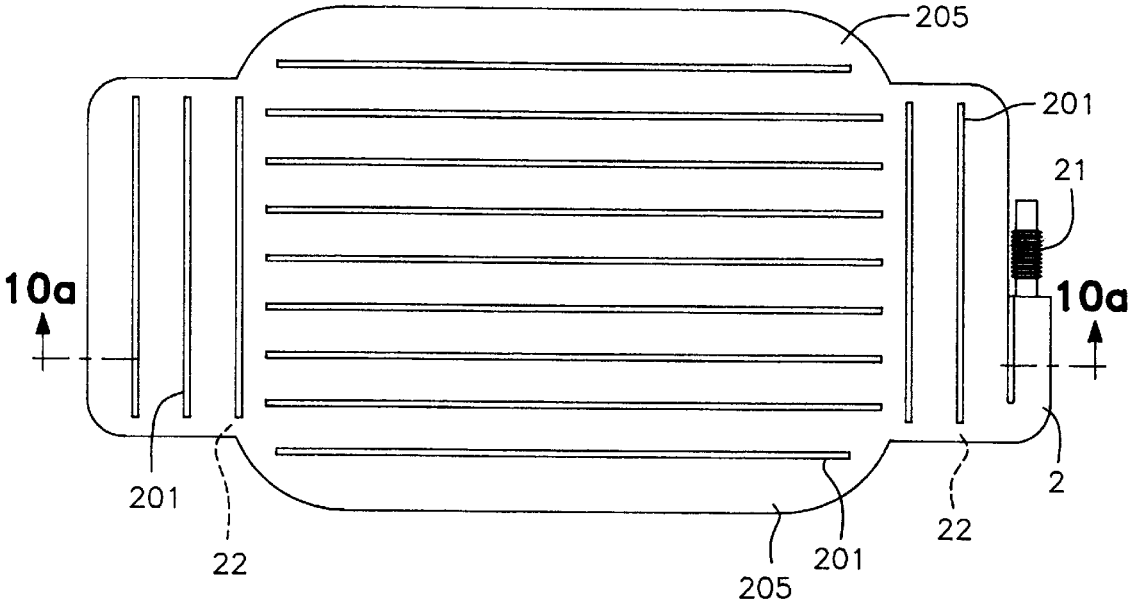
FIG. 10 is a top plan view of still another embodiment of an air cushion in the shoe tongue in accordance with the present invention.
Figure 10A:
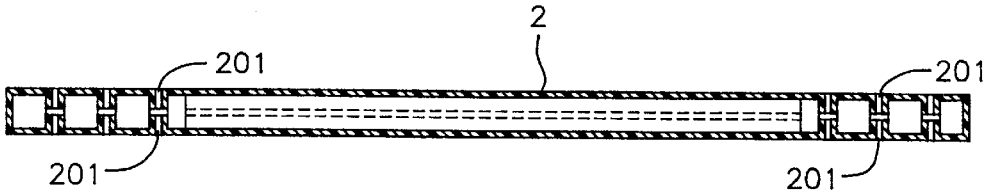
FIG. 10*a* is a cross-sectional view taken on line 10*a*—10*a* of FIG. 10.

FIGS. 10, 10-1 show an example of air cushion 2 with crosswise and lengthwise linear recesses 201 combined at the same time. The ends of the crosswise or lengthwise linear recesses 201 are not connected with any circumferential edge. The crosswise linear recesses 201 do not meet the lengthwise linear recesses 201 so that passages 22 are formed around the circumferential edge. The cross-section of the inside of the cushion still is square-shaped, in spite of the crosswise and lengthwise linear recesses 201. An air nipple 23 or an inflation pump 21 can be provided with this cushion. This cushion is provided with extending-out wings 205 to make it broader to cover the foot.

Figure 11:
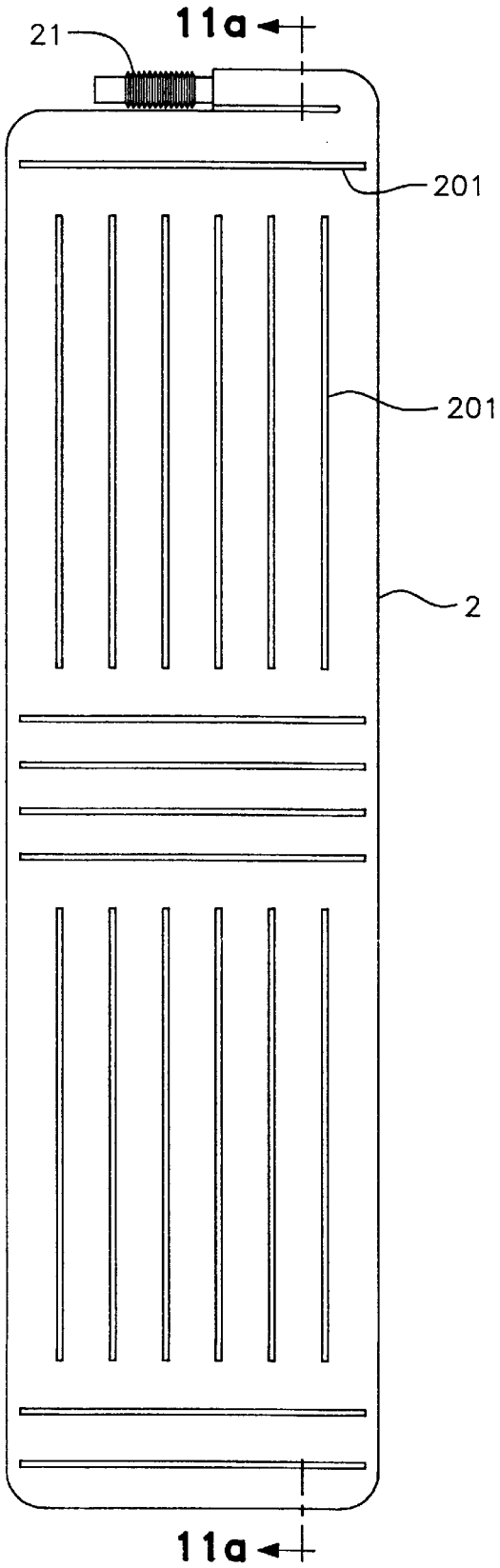
FIG. 11 is a top plan view of another embodiment of an air cushion in the shoe tongue used for boots in accordance with the present invention.
Figure 11A:
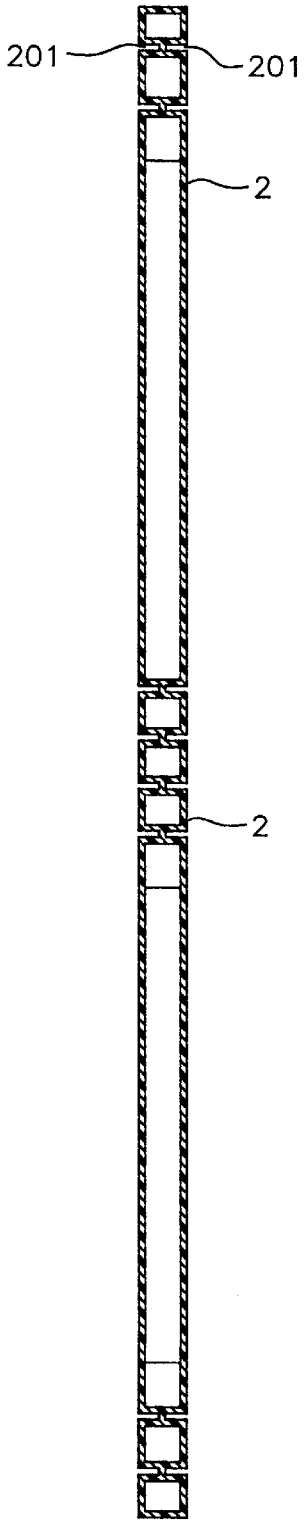
FIG. 11*a* is a cross-sectional view taken on line 11*a*—11*a* of FIG. 11.

FIGS. 11, 11-1 show an example of an air cushion used for boots quite similar to the example shown in FIG. 10.

Figure 12:
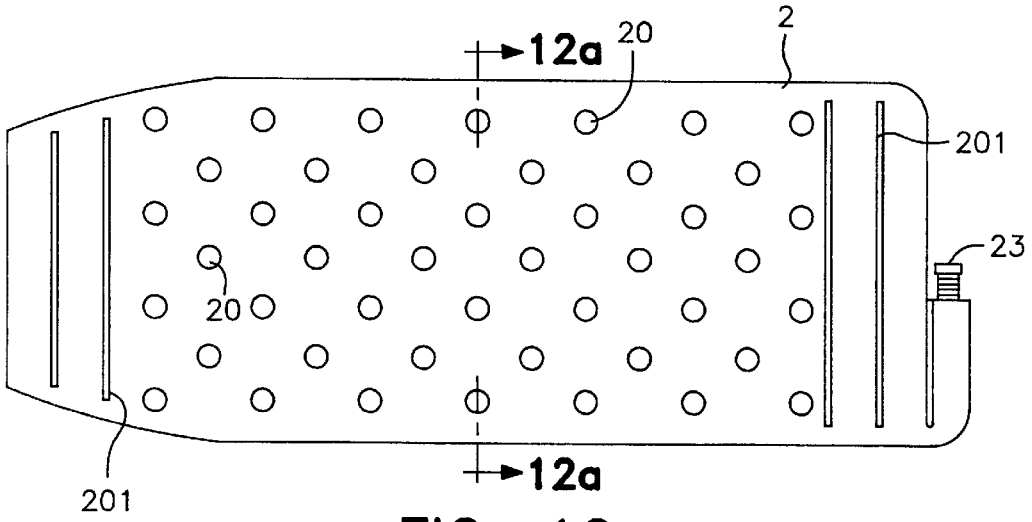
FIG. 12 is a top plan view of another embodiment of an air cushion in the shoe tongue in accordance with the present invention.
Figure 12A:
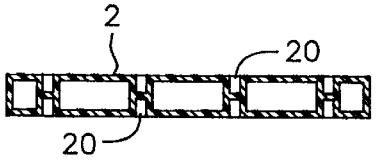
FIG. 12*a* is a cross-sectional view taken on line 12*a*—12*a* of FIG. 12.

FIGS. 12, 12-1 show an example of an air cushion 2 provided with many round recesses 20 and a few crosswise linear recesses 201 and an air nipple 23. The round recesses 20 and the linear recesses 201 have the illustrated cross-section. This cushion has its inside hollow spaces in mutual communication, except for the places where the round recesses 20 and the linear recesses 201 are located. This kind of cushion can also be made with a little wider front part to cover the eyelets 11 of the cover 1 in order to widely cover the foot.

Figure 13:
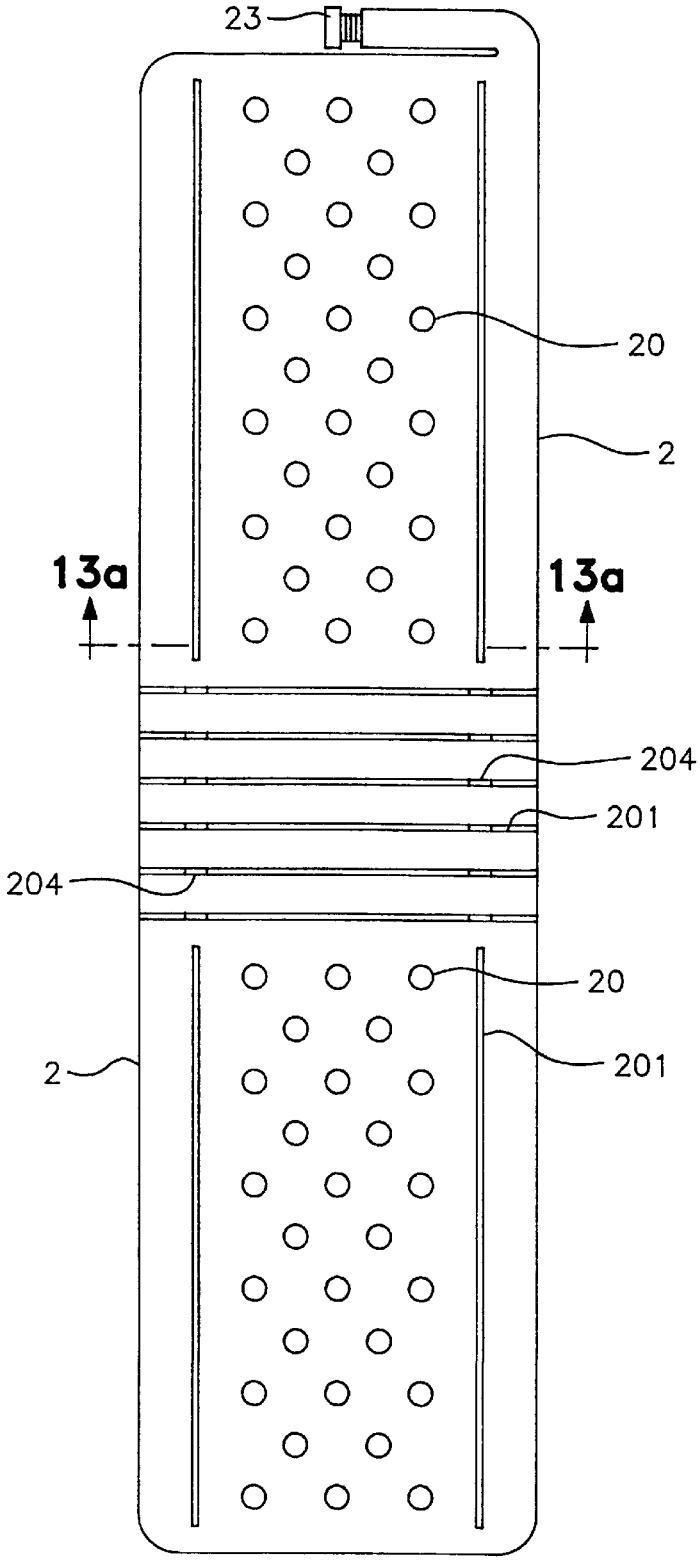
FIG. 13 is a top view of another embodiment of an air cushion in the shoe tongue used for boots in accordance with the present invention.
Figure 13A:
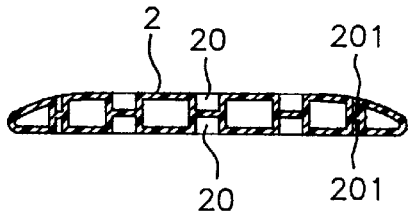
FIG. 13*a* is a cross-sectional view taken on line 13*a*—13*a* of FIG. 13.

FIGS. 13, 13-1 show an example of an air cushion provided with a combination of round recesses 20 and crosswise and lengthwise linear recesses 201. Both ends of the lengthwise linear recesses 201 do not connect with any circumferential edge for forming passages 22. However, the crosswise linear recesses 201 are connected with both circumferential edges and are provided with short tubes 204 set across them as shown in FIG. 8 for the air inside to pass through in order that this cushion may have a crosswise bending capability to cope with the inclined upper face of the foot. Either an air nipple 23 or an inflation pump 21 can be provided in this cushion 2.

Figure 14:
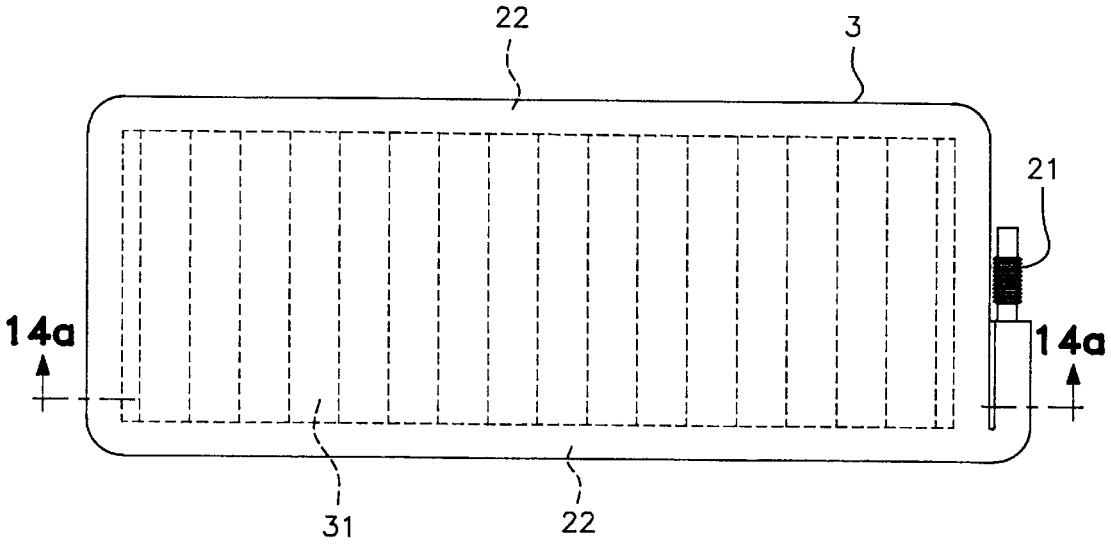
FIG. 14 is a top plan view of another embodiment of an air cushion inside the shoe tongue in accordance with the present invention.
Figure 14A:
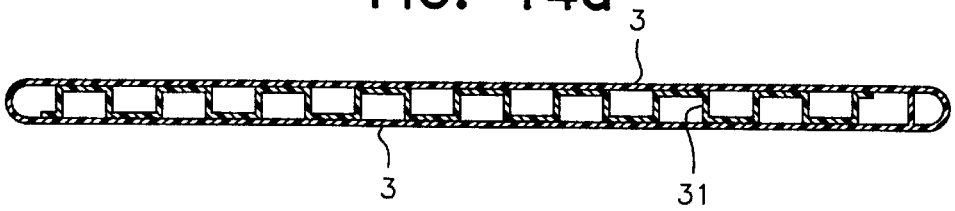
FIG. 14*a* is a cross-sectional view taken on line 14*a*—14*a* of FIG. 14.

FIGS. 14, 14-1 show an example of an air cushion 3, wherein a continuous, bent middle sheet 31 adheres to the upper and the lower sheets intermittently at spaced locations. The middle sheet 31 has a narrower width than that of the air cushion 3 such that passages 22 are formed by means of the difference of their widths. This kind of air cushion can have flatter surfaces than the others.

Figure 15:
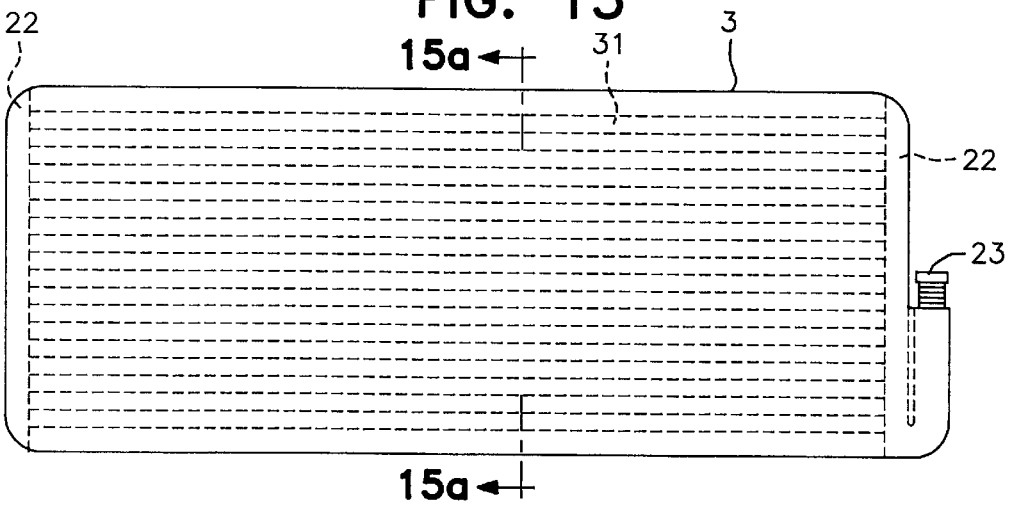
FIG. 15 is a top plan view of another embodiment of an air cushion inside the shoe tongue in accordance with the present invention.
Figure 15A:
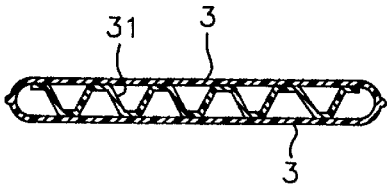
FIG. 15*a* is a cross-sectional view taken on line 15*a*—15*a* of FIG. 15.

FIGS. 15, 15-1 show an example of an air cushion quite similar to the example of FIG. 14. The difference between them consists in the shape of the middle sheet 31 set between the upper and the lower sheets. This middle sheet 31 has a continuously bent slope and also is adhered to the upper and the lower sheets intermittently at spaced locations. This cushion can also have flatter surfaces than the others.

Figure 16:
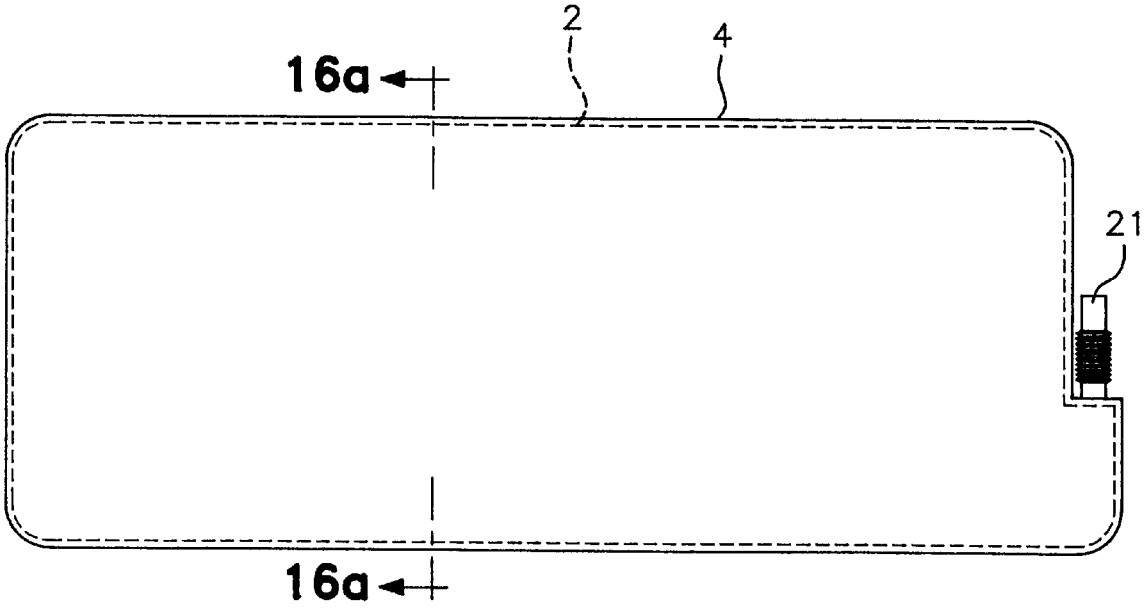
FIG. 16 is a top plan view of another embodiment of an air cushion inside the shoe tongue in accordance with the present invention.
Figure 16A:
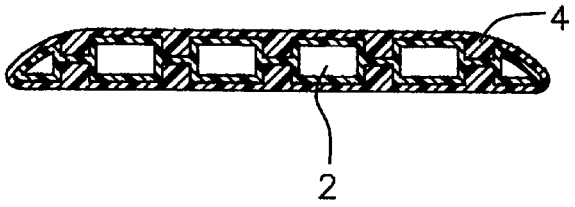
FIG. 16*a* is a cross-sectional view taken on line 16*a*—16*a* of FIG. 16.

The air cushion used in a shoe tongue can also be made by means of heat sealing as shown in FIGS. 16, 16-1. A layer of foam material has to be added on the surface of this cushion to make it flat as this cushion made through heat sealing can have a rather rough surface.

Figure 18:
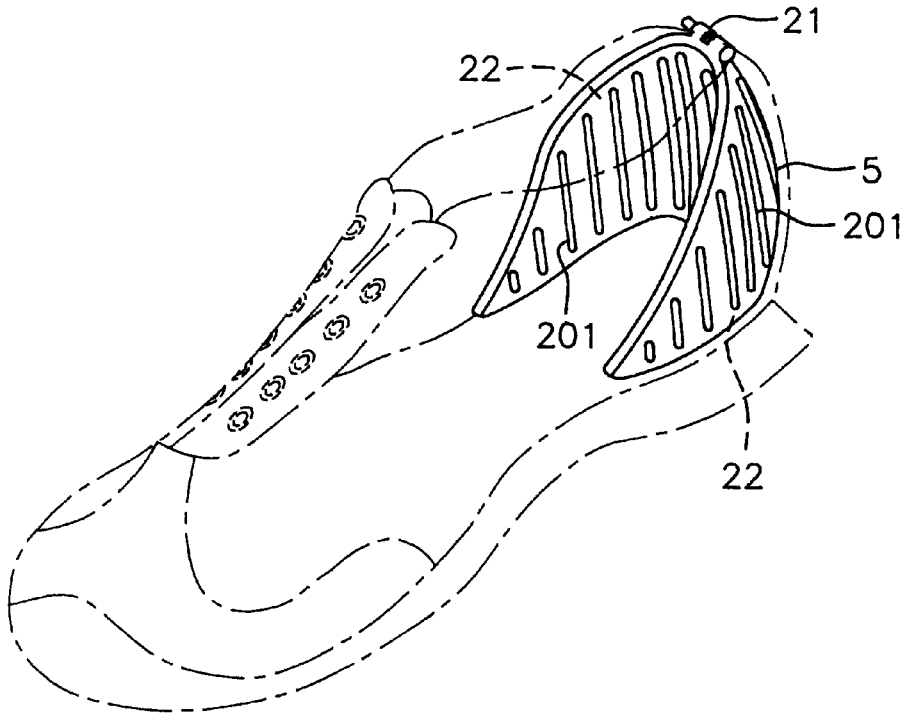
FIG. 18 is a perspective view of a shoe counter with the shock absorbing cushion device shown in a shoe illustrated in phantom lines in accordance with the present invention.
Figure 20:
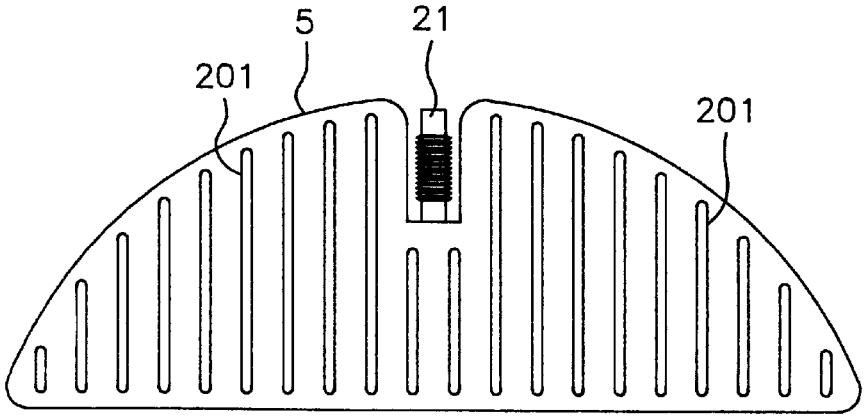
FIG. 20 is a top plan view of another embodiment of a shoe counter with the shock absorbing cushion device in accordance with the present invention.
Figure 21:
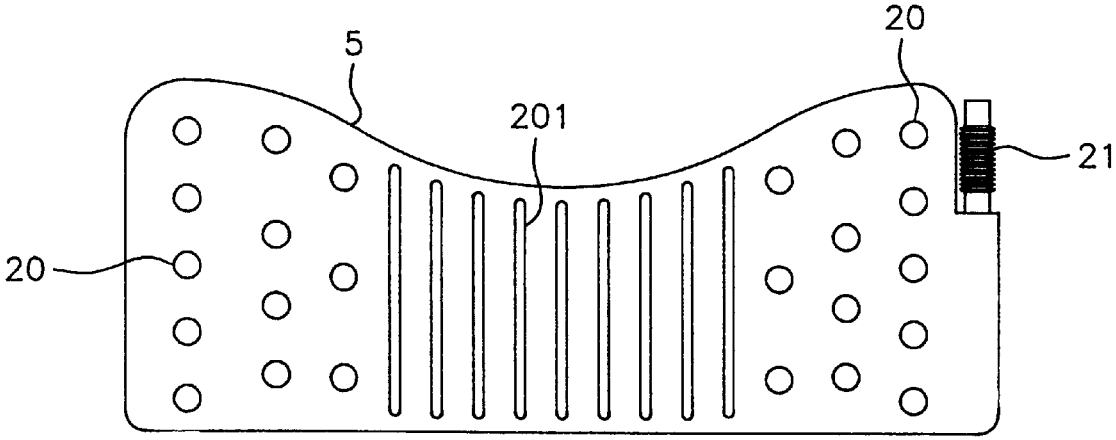
FIG. 21 is a top plan view of another embodiment of a shoe counter with the shock absorbing cushion device in accordance with the present invention.

FIGS. 18, 20, 21 show a shoe counter cushion 5 provided with this shock-absorbing cushion device for a sports shoe. The counter cushion 5 comprises crosswise linear recesses 201 adhering the upper sheet to the lower sheet. The hollow width of said linear recesses 201 allows the cushion 5 to conform to the vertical face of the heel to absorb shock. An inflation pump 21 or an air nipple 23 can be used in this device.

Figure 19:
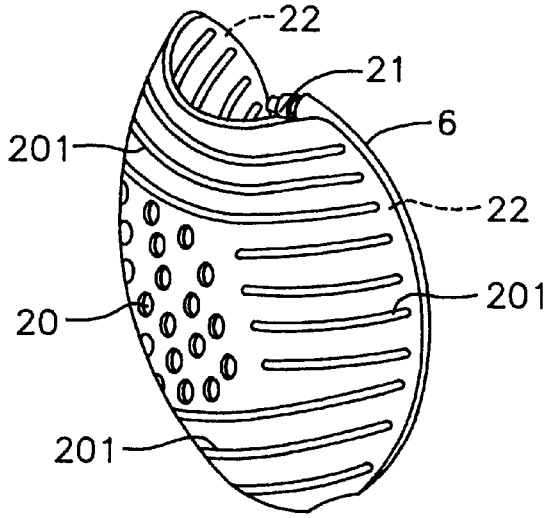
FIG. 19 is a perspective view of a knee protector with this shock absorbing cushion device in accordance with the present invention.

FIG. 19 shows a kind of knee protector which comprises an air cushion 6 in accordance with the present invention. The cushion 6 is provided with crosswise linear recesses 201 on the upper and the lower sheets. The height of the recesses 201 serves as bending space for the knee, ensuring the function of protecting the knee from being hurt but not hampering the movement of the knee. This cushion 6 can be provided with an inflation pump 21 or an air nipple 23.

Of course, this shock-absorbing structure can not only be applied to a shoe tongue, a counter cushion for sports shoes and a knee protector as described above, but also to a shoulder protector, or any other sports goods.

After an air cushion 2 is sealed in a cover 1, both of them make up a shock-absorbing structure removable, pressure-adjustable and ready to be used in sports shoes.

To inflate air into the air cushion 2, the inflation pump 21 is expanded or pulled lengthwise as shown in FIG. 3. As the pump 21 is pulled long and extended, a vacuum condition is produced inside the pump 21, thereby sucking air into the open one-way valve 215 at the front of the pump 21. When the pump 21 is pushed short and retracted instead of expanded, the air drawn inside is compressed to close the valve 215 and to push open the one-way valve 213 at the same time so that the air is pushed and flows into the air cushion 2. Repeating these actions to expand and to contract the pump 21 inflates the cushion 2 to the extent desired.

On the contrary, to deflate or decrease the inside pressure of the air cushion 2, the valve 215 should be pushed open backward to make the bar 217 push the valve 213 open so that the air inside the cushion can be expelled out to the extent desired as shown in FIG. 4.

In general, this shock-absorbing cushion device in accordance with the present invention not only has a special practical usefulness, but also is effective in preventing injuries during exercise or playing a sport. In addition, its special features are removability, adjustability in its pressure and the excellent elasticity against shock even if it is not inflated.

The interior of the air cushion can be filled with air, foamed polyurethane, water, oil, or any fluid of low percolation.

What is claimed is:

1. A molded shock-absorbing cushion for sports goods, comprising:

a pressurizable cushion having upper and lower sheets of synthetic plastic material each respectively generally residing in an upper and lower plane, said sheets being superimposed and bounding an interior space, said sheets extending lengthwise along a longitudinal direction, said sheets having a common peripheral edge and an inlet extending through the peripheral edge; a plurality of upper recesses formed in the upper sheet, each upper recess having an open upper end generally located in the plane of the upper sheet, and upper side walls extending away from a respective upper end toward the lower sheet and terminating in a closed lower end; a plurality of lower recesses formed in the lower sheet, each lower recess having an open lower end generally located in the plane of the lower sheet, and lower side walls extending away from a respective lower end toward the upper sheet and terminating in a closed upper end; each upper recess being aligned and symmetrical with a respective lower recess, and each closed lower end of a respective upper recess being integral with each closed upper end of a respective lower recess to form a common closed end for each pair of aligned upper and lower recesses, said common closed end being located between the upper and lower sheets and connecting the upper and lower sheets together at each said common closed end; a closing means cooperating with the inlet, said inlet adapted to admit a fluid into the entire interior space of the cushion to space the upper and lower sheets apart from each other, said spaced-apart upper and lower sheets generally positioned in respective planes and being free of upstanding projections; and a cover for containing the pressurized cushion and means on the cover for fastening the shock-absorbing cushion to sports goods, said cover being made of foam material.

* * * * *